US007757320B2

(12) United States Patent
Lord et al.

(10) Patent No.: US 7,757,320 B2
(45) Date of Patent: Jul. 20, 2010

(54) INFANT CHANGING PAD

(75) Inventors: John Lord, Lakewood, CO (US); Donald Seigler, Denver, CO (US)

(73) Assignee: Summer Infant, Inc., Woonsocket, RI (US)

( * ) Notice: Subject to any disclaimer, the term of this patent is extended or adjusted under 35 U.S.C. 154(b) by 109 days.

(21) Appl. No.: 11/435,318

(22) Filed: May 16, 2006

(65) Prior Publication Data

US 2007/0266498 A1 Nov. 22, 2007

(51) Int. Cl.
*A47D 5/00* (2006.01)

(52) U.S. Cl. ..... 5/655; 5/425; 5/946

(58) Field of Classification Search ..... 5/655, 5/924, 424–425, 946, 926, 948
See application file for complete search history.

(56) References Cited

U.S. PATENT DOCUMENTS

| | | | | | |
|---|---|---|---|---|---|
| 2,102,281 | A | * | 12/1937 | Pringle | 128/875 |
| 2,598,999 | A | | 6/1952 | Kelly | |
| 2,619,958 | A | * | 12/1952 | Day et al. | 128/876 |
| 2,846,700 | A | * | 8/1958 | De Puy | 5/424 |
| 3,305,878 | A | | 2/1967 | Hellbaum | |
| 3,319,273 | A | | 5/1967 | Solin | |
| 3,389,411 | A | | 6/1968 | Emery | |
| 3,811,140 | A | | 5/1974 | Burpo | |
| 3,871,637 | A | | 3/1975 | Mueller et al. | |
| 4,579,111 | A | | 4/1986 | Ledesma | |
| 4,606,088 | A | | 8/1986 | Michaelson et al. | |
| 4,712,258 | A | * | 12/1987 | Eves | 5/424 |
| 5,161,273 | A | * | 11/1992 | Deck | 5/601 |
| 5,906,015 | A | | 5/1999 | Hilger et al. | |
| 6,009,874 | A | * | 1/2000 | Sartin et al. | 128/869 |
| 6,026,525 | A | * | 2/2000 | Davis | 5/99.1 |
| 6,125,487 | A | * | 10/2000 | Ive | 5/655 |
| 2006/0016013 | A1 | | 1/2006 | Lord et al. | |

* cited by examiner

*Primary Examiner*—Fredrick Conley
(74) *Attorney, Agent, or Firm*—IP Strategies

(57) ABSTRACT

A changing pad includes a resilient support that has a generally flat base with a bottom surface. A peripheral wall extends upwardly of the base to form a region wherein an infant may be placed. A strap assembly includes a first and second strap portions, each of which having one end secured to the resilient support proximately to the first and second bottom side edges, respectively. Cooperative fastening elements releasably connect to other ends of the two strap portions. The locations of the connections of the strap portions to the bottom edges may be set back an inset distance to allow use with fitted coverings.

31 Claims, 4 Drawing Sheets

INFANT CHANGING PAD

FIELD OF THE INVENTION

The present invention broadly relates to infant changing pads of the type adapted to support an infant while changing his/her diaper or for other purposes in an inclined position. The embodiments disclosed herein may be used as a free-standing unit of placed on a tabletop, dresser top, vehicle cargo bed, or the like, or secured to an article for stability. As such, the infant support cushion provided a comfortable, sanitary surface for the infant.

BACKGROUND OF THE DISCLOSURE

While the needs of an infant broadly concern warmth, sleep, food and hygiene, caring for an infant is a formidable task. As a result, infant care providers often seek products and methods which make caring for an infant's needs easier for the care provider as well as more beneficial for the infant. Numerous baby products, such as baby cribs, baby bottles, food utensils, strollers and the like have made infant care simpler and more enjoyable for the care provider.

In the area of infant hygiene, disposable diapers have dominated the market place although it is still known to use washable, reusable cloth diapers. However, regardless of the choice between disposable and reusable diapers, problems continue in providing a sanitary surface on which the infant may be laid during the changing procedure.

Often, where appropriate, the care provider changes the infant's soiled diaper on a bed, in a crib or on a changing table. Sometimes, a changing sheet, towel or the like may be placed on the changing surface in order to provide a more sanitarily controlled condition for the infant. Such covering may also be more protective of the infant's skin and provide an insulating layer between infant and a cold surface.

Accordingly, it is known to provide infant changing pads that include a relatively thick, resilient cushion that may optionally be enclosed in some sort of a cover or casing. An example of one such infant changing pad is disclosed in U.S. Pat. No. Des. 338,110 issued Aug. 10, 1993 to Peay. A foldable infant support cushion adapted for changing an infants diapers is disclosed in U.S. Pat. No. 6,125,487 issued Oct. 3, 2000 to Ive. In each of these patents, a trough shaped upper surface is provided whereon the infant may be laid.

OBJECTS AND ASPECTS OF THE EXEMPLARY EMBODIMENT

It is an object of the present invention to provide a new and useful infant changing cushion adapted to support an infant in an reclined position for diaper changing or other purposes.

It is an aspect of the exemplary embodiment to provide an infant support cushion wherein an infant may be secured therein by adjustable straps.

Another aspect of the exemplary embodiment is to provide a cushion for an infant which is designed with a resilient laying surface having a concavity in order to inhibit the infant from rolling off of the changing pad.

Yet another aspect of the exemplary embodiment is to provide an infant changing pad that can be placed on a support surface of a support structure and secured thereto so as to resist movement of the changing pad.

Still another aspect of the exemplary embodiment is to provide an infant changing pad that has an anti-slip material on its bottom surface so as to resist sliding motion thereof.

According to the broad aspects of the exemplary embodiment of the present invention, a changing pad is provided that is adapted to support an infant. Broadly, the exemplary embodiment includes a resilient support and a strap assembly. The resilient support includes a generally flat base having a bottom surface with oppositely disposed first and second bottom side edges and a peripheral wall extending upwardly of and in surrounding relation to the base portion to form a concavity operative to support the infant therein. The strap assembly includes a first strap portion secured to the resilient support at a first location proximately to the first bottom side edge and terminating in a first free end portion to define a first effective length. A second strap portion is secured to the resilient support at a second location proximate to the second bottom side edge. The second strap portion terminates in a second free end portion to define a second effective length therefore. Cooperating fastening elements that are releasably connectable to one another are respectively disposed on the first and second free end portions of the first and second strap portions whereby the first and second strap portions may be extended across an infant placed in the concavity with the free end portions fastened together so as to secure the infant relative to the resilient support.

The exemplary embodiment also discloses that at least one of the first and second effective lengths of the strap portions is selectively variable. Moreover, the first and second strap portions may be joined together by a central strap portion extending between the first and second locations. Here, the first, second and central strap portions are formed of a single piece of strap material. Also, if desired, the strap assembly may include a third strap portion connected to the first strap portion at a third location. The third strap portion may optionally include a clamp element secured to the first strap portion of the third location and an length of strap material adapted to be releasably engaged by the clamp element.

In the exemplary embodiment, the resilient support includes a cushion formed of a soft resilient material and a cover. The cushion includes a generally flat base portion having a bottom surface with oppositely disposed first and second lower side edges and oppositely disposed first and second lower end edges. A peripheral wall extends upwardly of and in surrounding relation to the base portion so as to define a concavity adapted to support the infant.

The cover includes a bottom panel having first and second bottom side edges, side panels, end panels and a top panel connected together so as to have an interior adapted to receive the cushion therein through an opening formed in the cover with a bottom panel confronting the lower surface of the flat base portion and with the top panel extending across the concavity. Here, the first strap portion is secured to the cover at a first location proximately to the first bottom side edge of the bottom panel and the second strap portion is secured to the cover at a second location proximately to the second bottom side edge of the bottom panel.

According to the exemplary embodiment, it is desirable that both of the first and second locations be inset from the first side edge a selected inset distance along the bottom surface of the changing pad. This allows convenient use of an optional fitted casing. Where the first location is inset from the first bottom side edge, the third location is spaced from the first location a third distance about the same as the first distance.

Moreover, according to the exemplary embodiment, the bottom panel of the cover is formed of a high friction, anti-slip material, while the top panel is formed of a liquid resistant material. Both of these materials may be vinyl having the appropriate characteristics.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

The present invention broadly relates to infant changing pads of a type that may be either freestanding for placement on the floor, truck bed or other support surface or which may be releasably secured, for example, to an article of furniture. Broadly, the invention includes a resilient support adapted to support an infant and a strap assembly adapted to secure the infant therein. These features are illustrated by the exemplary embodiment described herein.

Figure 1:
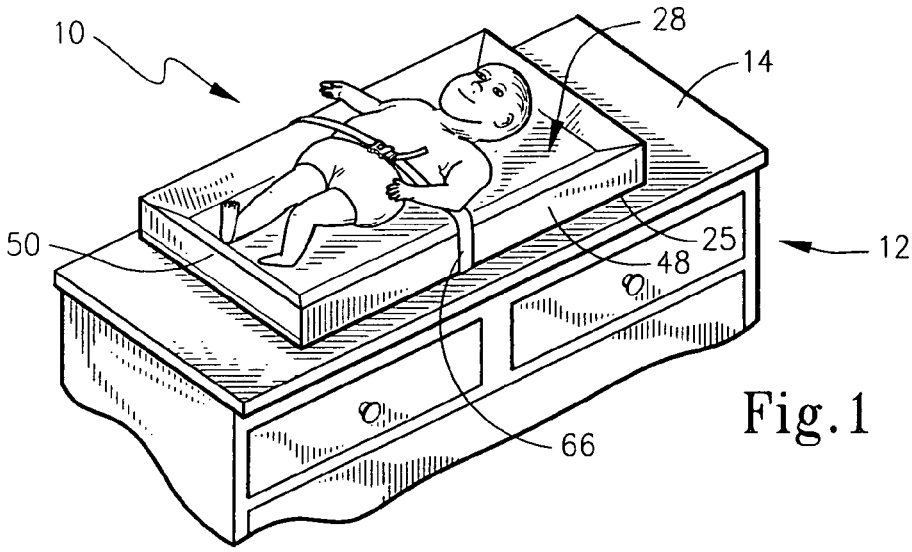
FIG. 1 is a perspective view of an infant changing pad according to the exemplary embodiment of the present invention shown positioned on a support surface in the form of an article of furniture, namely, a dresser.
Figure 2:
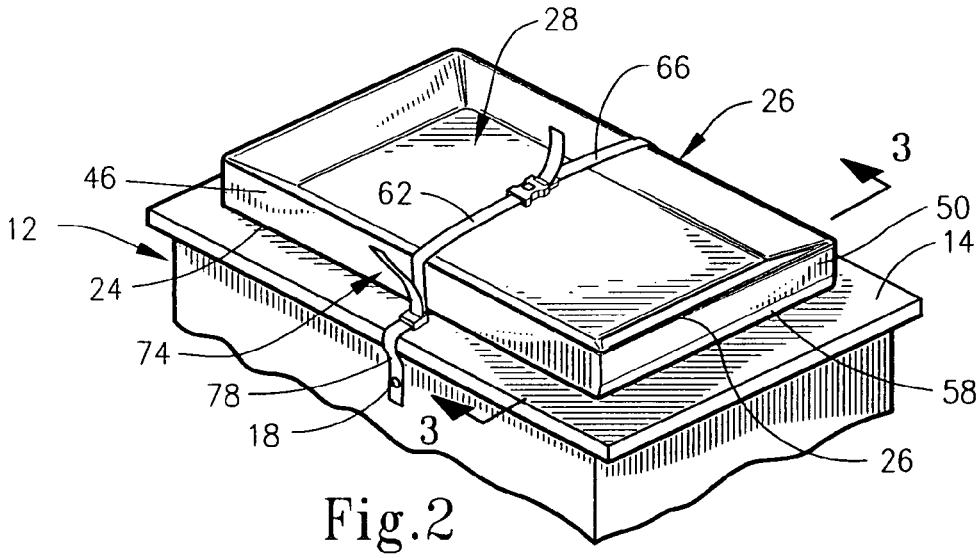
FIG. 2 is a rear perspective view of the infant changing pad according to Claim 1 without the infant placed thereon.
Figure 3:
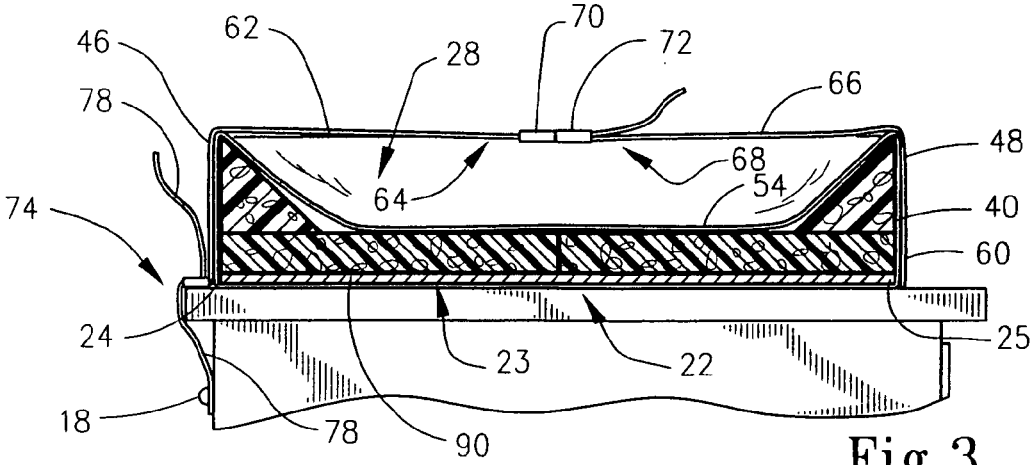
FIG. 3 is a cross-sectional view taken about lines 3-3 of FIG. 2.
Figure 4:
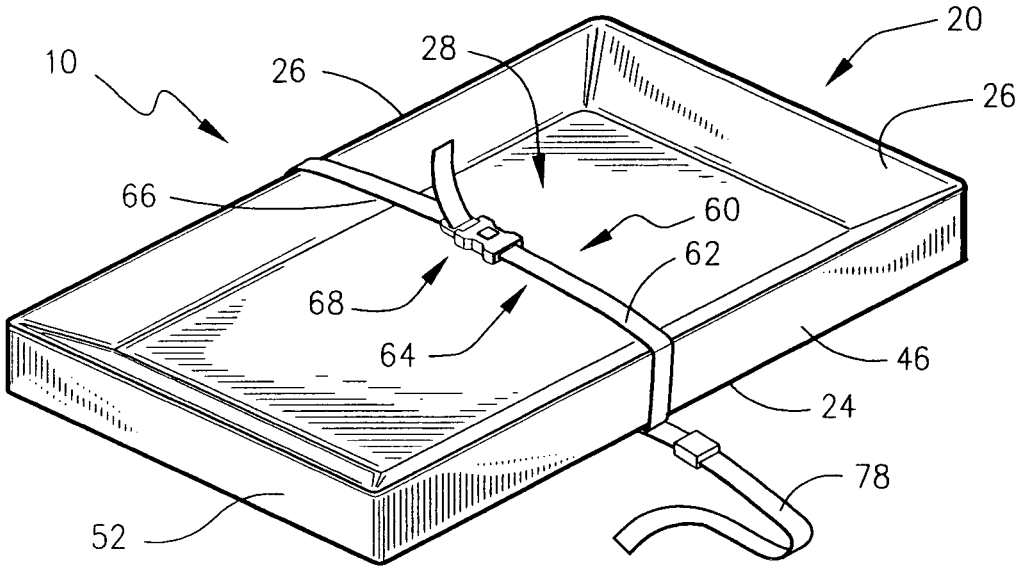
FIG. 4 is a rear perspective view of the infant changing pad of FIGS. 1-3 shown in a freestanding manner.
Figure 6:
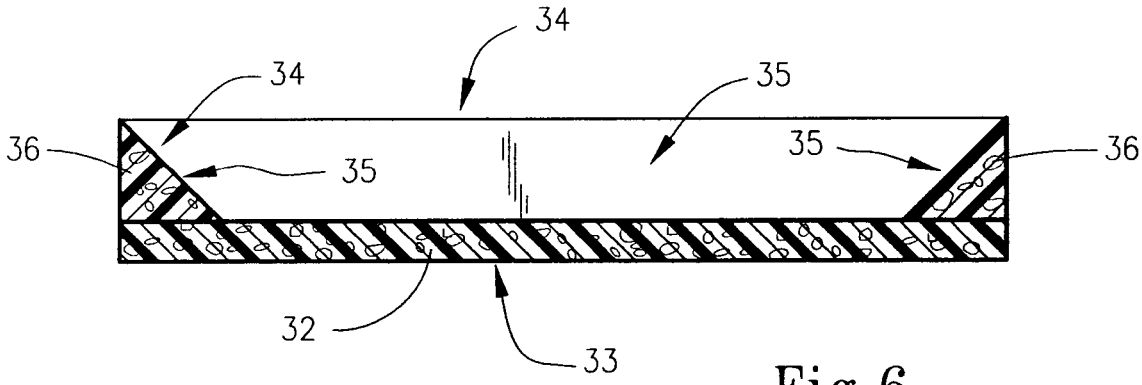
FIG. 6 is a side view in cross-section of the cushion used with the infant changing pad of FIG. 4.
Figure 7:
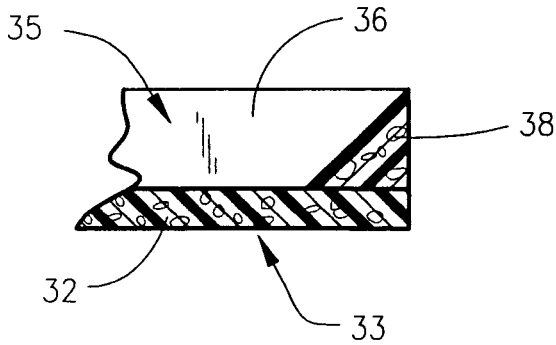
FIG. 7 is an end view in cross-section of the cushion of FIG. 6.

Accordingly, a changing pad 10 according to the exemplary embodiment of the present invention is introduced in FIG. 1. Here, changing pad 10 is shown positioned on the upper surface 14 of a dresser 12. In FIG. 1, an infant 16 is shown received in a concavity 28 of changing pad 10 and secured therein by a strap assembly 60. With reference to FIGS. 2 and 3, it may be seen that changing pad 10 may optionally be secured to the article of furniture by means of a suitable fastener such as a screw, nail, snap 18, as described more thoroughly below.

With reference now to FIGS. 1-9, it may be seen that changing pad 10 includes a resilient support 20 and a strap assembly 60. Resilient support 20, in turn, is formed by a cushion 30, a casing 40 and an optional reinforcement panel 90, described more thoroughly below. It should be understood, however, that resilient support 20 could be of a construction other than that as described with respect to the exemplary embodiment without departing from the scope of this invention.

With reference again to the Figures, it may be seen that resilient support 20 has a generally flat base 22 having a bottom surface 23 with oppositely disposed first and second bottom side edges 24 and 25. Further, resilient support 20 includes a peripheral wall 26 extending upwardly and in surrounding relation to said base to form a concavity 28 operative to support the infant therein.

Strap assembly 60 is illustrated in FIGS. 2, 3, 4, 8 and 9 wherein it may be seen that strap assembly 60 in the exemplary embodiment is secured to a cover 40. More particularly, strap assembly 60 includes a first strap portion 62 secured to the resilient support 20 at a first location 63 proximately to but inset from the first bottom side edge 24 (edge 43 of cover 40). First strap portion 62 terminates in a first free end portion 64 to define a first effective length. A second strap portion 66 is secured to the resilient support at a second location 67 that is proximate to and inset from second bottom edge 25 (edge 44 of cover 40) and terminates in a second free end portion 68 to define a second effective length. These insets allow easier use of a fitted sheet or casing since the elastic bands can pass between the straps and the cover without bunching up while the straps are extended around the resilient support.

Cooperative fastening elements are releasable connectable to one another and are respectively disposed on the first and second free end portions of first and second strap portions 62 and 66. As is seen in FIG. 3, for example, a first cooperative fastening element 70 is secured to first free end portion 64 of strap portion 62 while a second cooperative fastening element 72 is secured to second free end portion 68 of strap portion 66. These may be of any type generally known in the art. Accordingly, the first and second strap portions 62, 66 may be extended across an infant placed in concavity 28 with the free end portions thereof fastened together so as to secure the infant relative to the resilient support 20. Moreover, it may be seen that the effective length of at least one of the strap portions may be adjusted to accommodate different sized infants. Here, cooperative fastening element 72 is such that the effective length of second strap portion 66 may have an adjustable length.

With continued reference to the Figures, it may be further appreciated that resilient support 20 may be formed by cushion 30 and cover 40. As is illustrated in this figure, cushion 30 includes a generally flat base portion 32 having a lower surface 33 and a peripheral wall portion 34 extending upwardly of base portion 32 so as to define the concavity 28. Peripheral wall 34 accordingly has upwardly divergent inner wall surfaces 35. Cushion 30, in the exemplary embodiment, is generally rectangular in shape so that the peripheral wall portion 34 is formed by a pair of generally parallel sidewall sections 36 and a pair of generally parallel end wall sections 38.

Figure 5:
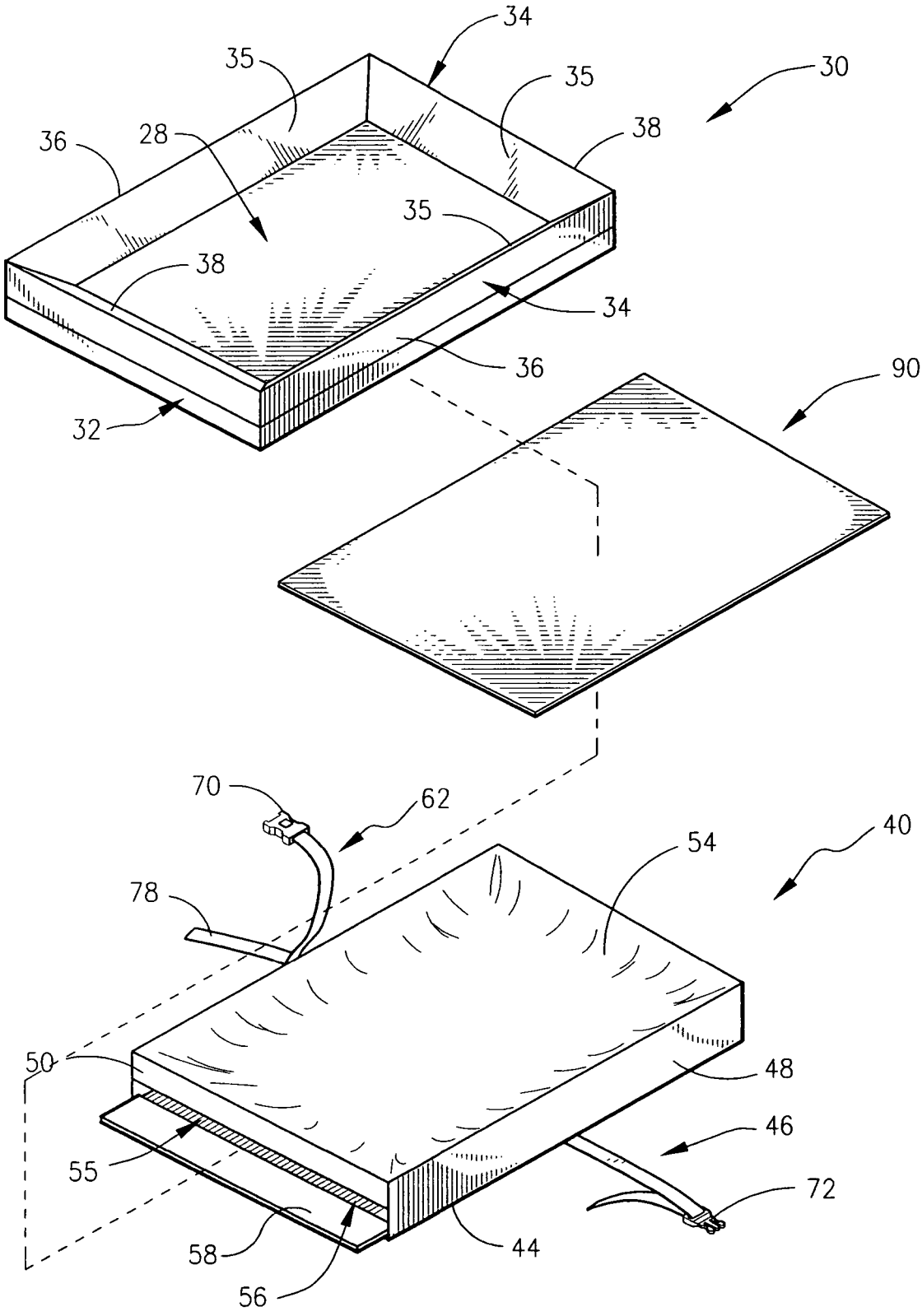
FIG. 5 is an exploded perspective view of the infant changing pad of FIG. 4.

It may be seen in the Figures that cover 40 includes a bottom panel 42 having first and second bottom side edges 43 and 44. Cover 40 further includes side panels 46 and 48 as well as end panels 50 and 52. A top panel 54 is also provided with these panels connected together so as to have an interior 55 adapted to receive cushion 30 therein. To this end, an opening 56 is provided between bottom panel 42 and end panel 50. As is seen in FIG. 5, end panel 50 is not joined to the bottom panel 32 so as to define the opening 56. A flap portion 58 is then provided and is formed as an extension of bottom panel 42 with flap portion 58 being including an adhesive material 59 so that flap portion 58 may be inserted through the opening and adhered to end panel 50.

Figure 8:
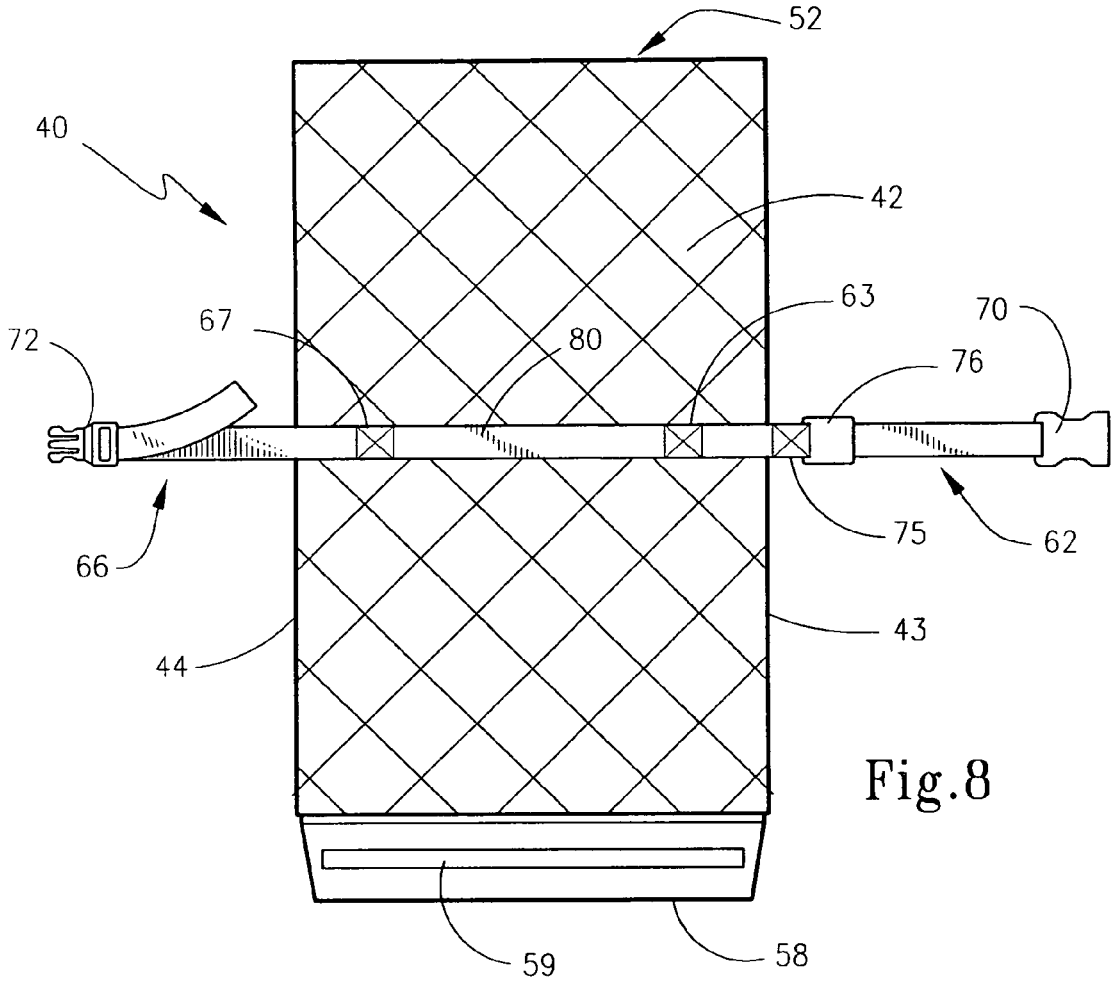
FIG. 8 is a bottom plan view of the cover and strap assembly according to the exemplary embodiment of the present invention.
Figure 9:
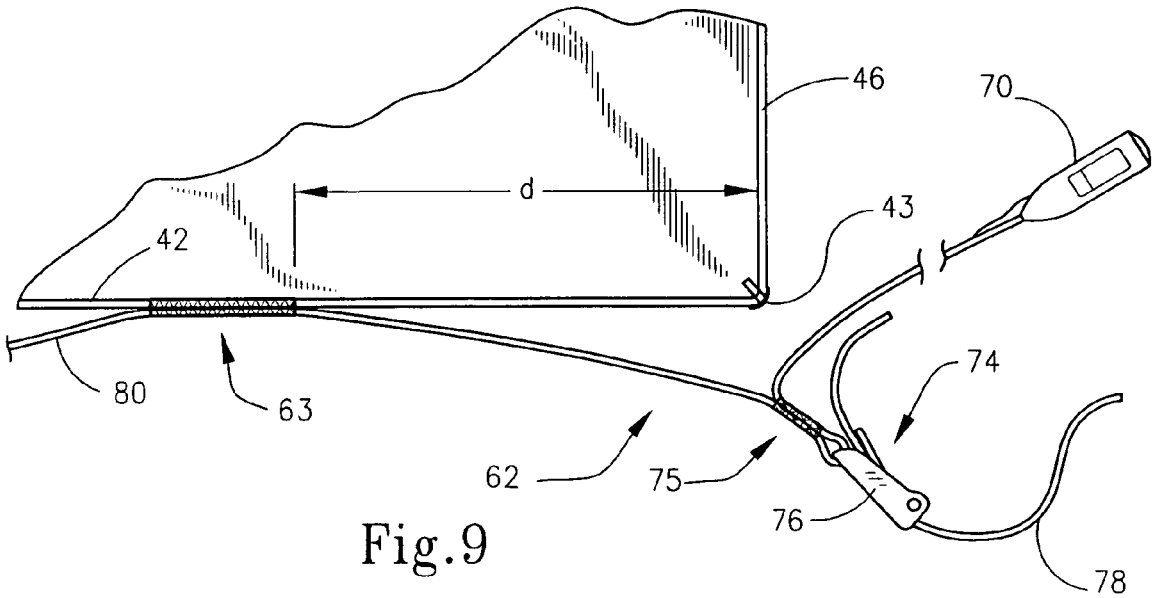
FIG. 9 is an enlarged cross-sectional view of a portion of the cover and a portion of strap assembly according to the exemplary embodiment of the present invention.

Strap assembly 60 may be seen in greater detail in FIGS. 8 and 9. Here, it may be seen that first strap portion 62 is secured at first location 63 to bottom panel 42 at an inset distance "d" from side edge 43. Likewise, second strap portion 66 is secured at second location 67 that is inset approximately in equal distance "d" from second side edge 44. Moreover, as is shown in these figures, as well as in FIGS. 2 and 3, a third strap portion 74 may be connected to first strap portion 62 at a third location 75 that is spaced from first location 63 at a distance about the same as the inset distance "d". Third strap portion 74 in this exemplary embodiment includes a clamp element 76 secured to the first strap portion at the third location and a length of strap material 78 that is adapted to be releasably engaged by the clamp element 76. With reference now again to FIGS. 2 and 3, it may be seen that the length of strap material 78 may be fastened to the article of furniture by means of fastening element 18. Since clamp 76 releasably clamps onto this length of strap material 78, the changing pad can be easily secured to and detached from the article of furniture. Furthermore, as may be seen in FIG. 8, first and second strap portions 62 and 66 may be joined together by a central strap portion 80 and, further, these strap portions may be formed by a single piece of strap material.

Finally, with reference again to FIG. 5, it may be seen that an optional reinforcing panel 90 may also be received in the interior 55 of cover 40 in order to help rigidify resilient cushion 30. Reinforcement panel 90 may be formed of any suitable material, such as paperboard, Masonite, and the like.

The components of changing pad may likewise be formed of any suitable material. In the exemplary embodiment, resilient cushion 30 is formed by a suitable open-celled foam material. Bottom panel 42 of cover 40 is constructed of any anti-slip or friction grip material of a type to help prevent changing pad 10 from sliding on a support surface. Vinyl materials well known in the art can provide such anti-slip property. The remaining portions of cover 40 are constructed of a suitable liquid resistant material, and vinyl fabrics may again be used, so as to prevent urine or other liquids from passing through the top panel.

Accordingly, the present invention has been described with some degree of particularity directed to the exemplary embodiments of the present invention. It should be appreciated, though, that the modifications or changes may be made to the exemplary embodiments of the present invention without departing from the inventive concepts contained herein.

We claim:

1. A changing pad adapted to support an infant, comprising:

a resilient support having an upper surface for supporting the infant and a bottom surface opposite the upper surface; and a strap assembly including:

a first strap portion secured directly to the bottom surface of said resilient support and terminating in a first free end;

a second strap portion secured directly to the bottom surface of said resilient support and terminating in a second free end;

cooperative first and second fastening elements respectively disposed on said first strap portion and said second strap portion, whereby said first and second strap portions are sufficiently sized so that they may be positioned to span across an infant placed on the upper surface and fastened together to maintain the infant relative to said resilient support; and a third strap portion including a length of strap material connected relative to said first strap portion at a location proximate to the bottom surface of said resilient support and extending away from said first strap portion and said resilient support to terminate in a third free end that may be fastened to an article of furniture.

2. A changing pad according to claim 1 wherein said resilient support includes:

(1) a cushion including a generally flat base portion having a lower surface and a peripheral wall portion extending upwardly of said base portion so as to define a concavity, and (2) a cover including a bottom panel that defines said bottom surface, side panels, end panels and a top panel connected together so as to have an interior adapted to receive said cushion therein through an opening formed in said cover, said first and second strap portions being secured to said cover.

3. A changing pad according to claim 2 wherein said bottom panel is constructed of an anti-slip material.

4. A changing pad according to claim 2 wherein said top panel is constructed of a liquid resistant material.

5. A changing pad according to claim 2 wherein said first strap portion is secured to said bottom panel only at a first location inset from a first bottom edge of the resilient support.

6. A changing pad according to claim 5 wherein said second strap portion is secured to said bottom panel only at a second location inset from a second bottom edge of the resilient support.

7. A changing pad according to claim 6 wherein the first and second inset distances are about equal.

8. A changing pad according to claim 1 wherein said third strap portion includes a clamp element secured to said first strap portion, said length of strap material adapted to releasably engage said clamp element.

9. A changing pad according to claim 8 wherein said clamp element is spaced apart from, and disengaged from, said first and second fastening elements.

10. A changing pad according to claim 1 wherein said first strap portion has a first effective length and second strap portion has a second effective length, and wherein at least one of said first and second strap portions has its associated fastening element movably disposed thereon to vary an effective length thereof.

11. A changing pad according to claim 1 wherein said resilient support includes a flat base having a bottom surface which includes said bottom edge, and a peripheral wall extending upwardly of and in surrounding relation to, said base to form a concavity operative to support the infant therein.

12. A changing pad according to claim 11 wherein said first strap portion is secured to said resilient support at a first location proximate to a first bottom edge of the bottom surface, and said second strap portion is secured to said resilient support at a second location proximate to a second bottom edge of the bottom surface.

13. A changing pad according to claim 12 further comprising a central strap portion extending along the bottom surface of said base between the first and second locations and joining said first and second strap portions together, said first, second and central strap portions formed as a single piece of strap material.

14. A changing pad adapted to support an infant, comprising:

(A) a cushion formed of a soft resilient material and including:

(1) a generally flat base portion having a bottom surface with oppositely disposed first and second lower side edges and oppositely disposed first and second lower end edges, and (2) a peripheral wall extending upwardly of and in surrounding relation to said base portion so as to define a concavity adapted to support an infant placed therein;

(B) a cover including a bottom panel having first and second bottom side edges, side panels, end panels and a top panel connected together so as to have an interior adapted to receive said cushion therein through an opening formed in said cover with said bottom panel confronting the lower surface of said flat base portion and with said top panel extending across the concavity; and (C) a strap assembly including:

(1) a first strap portion secured to said cover at a first location proximately to said first bottom side edge of the bottom panel and terminating in a first free end portion to define a first effective length, (2) a second strap portion secured to said cover at a second location proximately to said second bottom side edge of the bottom panel and terminating in a second free end portion to define a second effective length, (3) a central strap portion extending along the bottom surface of said base portion between the first and second locations joining said first and second strap portions together, wherein said first, second and central strap portions are formed of a single piece of strap material, (4) cooperative fastening elements releasably connectable to one another and respectively disposed on said first and second free end portions whereby said first and second strap portions may be extended across an infant placed in the concavity with the free end portions fastened together so as to secure the infant relative to said support cushion; and (5) a third strap portion connected to said first strap portion.

15. A changing pad according to claim 14 wherein said peripheral wall has upwardly divergent inner wall surfaces.

16. A changing pad according to claim 14 wherein said bottom panel is constructed of friction grip material and wherein said top panel is constructed of a liquid resistant material.

17. A changing pad according to claim 14 wherein said first strap portion is secured to the bottom panel of said cover with the first location being inset from the first bottom side edge a selected first inset distance along the bottom surface.

18. A changing pad according to claim 17 wherein said second strap portion is secured to the bottom panel of said cover with the second location being inset from the second bottom side edge a selected second inset distance along the bottom surface.

19. A changing pad according to claim 14 including a stiff reinforcement panel interposed between the bottom surface of said cushion and the bottom panel of said cover.

20. A changing pad according to claim 14 wherein said third strap portion includes a clamp element secured to said first strap portion and a length of strap material adapted to be releasably engaged by said clamp element.

21. A changing pad according to claim 14 wherein one of said end panels is not joined to said bottom panel so as to define the opening, and including a flap portion formed as an extension of said bottom panel, said flap portion including an adhesive material thereon whereby said flap portion may be adhered to said one of said end panels.

22. A changing pad according to claim 14 wherein said peripheral wall has upwardly divergent inner wall surfaces whereby the concavity has a sloping peripheral margin.

23. A changing pad according to claim 14 wherein said cushion is generally rectangular in shape with said peripheral wall formed by a pair of generally parallel side wall sections and a pair of generally parallel end wall sections.

24. A changing pad adapted to support an infant on an article of furniture having a flat upper support surface for receiving said changing pad, comprising:

(A) a cushion formed of a soft resilient material and including:

(1) a generally flat base portion having a bottom surface with oppositely disposed first and second lower side edges and oppositely disposed first and second lower end edges, and (2) a peripheral wall extending upwardly of and in surrounding relation to said base portion so as to define a concavity adapted to support an infant placed therein;

(B) a cover including a bottom panel having first and second bottom side edges, side panels, end panels and a top panel connected together so as to have an interior adapted to receive said cushion therein through an opening formed in said cover with said bottom panel confronting the lower surface of said flat base portion and with said top panel extending across the concavity;

(C) a primary strap assembly secured to said bottom panel and terminating in first and second primary strap free end portions to define an effective primary strap length, said first and second primary strap free end portions releasably and directly connectable to one another whereby a portion of said primary strap assembly may be extended across the infant when placed in the concavity, said primary strap including:

(1) a first strap portion secured directly to said resilient support at a first location inset from the first bottom side edge a selected first inset distance along the bottom surface, and terminating in a first free end portion to define a first effective length;

(2) a second strap portion secured directly to said resilient support at a second location proximately to said second bottom side edge and terminating in a second free end portion to define a second effective length, said first and second strap portions, respectively, being unsecured to said resilient support outwardly from said first and second locations to permit a fitted sheet to be received about said resilient support without interfering with said first and second strap portions;

(3) a central strap portion extending along the bottom surface of said base portion between the first and second locations joining said first and second strap portions together, wherein said first, second and central strap portions are formed as a single, unitary piece of flexible material; and (4) cooperative fastening elements releasably connectable to one another and respectively disposed on said first and second free end portions whereby said first and second strap portions may be extended around the fitted sheet, when present, and across an infant placed in the concavity with the free end portions fastened together so as to secure the infant relative to said support cushion; and (D) an auxiliary strap terminating in first and second auxiliary strap free end portions, said first auxiliary strap free end portion releasably connected to said primary strap and said second auxiliary strap free end portion attachable to the article of furniture to anchor said changing pad thereto.

25. A changing pad according to claim 24 including a clamp element disposed on said primary strap assembly for releasably connecting said auxiliary strap to said primary strap assembly to allow said changing pad to be separated from said auxiliary strap and the article of furniture.

26. A changing pad adapted to support an infant, comprising:

(A) a resilient support including:

(1) a generally flat base having a bottom surface with oppositely disposed first and second bottom side edges, and (2) a peripheral wall extending upwardly of and in surrounding relation to said base to form a concavity operative to support the infant therein; and (B) a strap assembly including:

(1) a first strap portion secured to said resilient support at a first location inset from the first bottom side edge a selected first inset distance along the bottom surface, and terminating in a first free end portion to define a first effective length, (2) a second strap portion secured to said resilient support at a second location proximately to said second bottom side edge and terminating in a second free end portion to define a second effective length, (3) a third strap portion connected to said first strap portion at a third location spaced from the first location at a third distance about the same as the first distance; and (4) cooperative fastening elements releasably connectable to one another and respectively disposed on said first and second free end portions whereby said first and second strap portions may be extended across an infant placed in the concavity with the free end portions fastened together so as to secure the infant relative to said resilient support.

27. A changing pad according to claim 26 wherein said third strap portion includes a clamp element secured to said first strap portion at the third location and a length of strap material adapted to be releasably engaged by said clamp element.

28. A changing pad adapted to support an infant, comprising:

(A) a resilient support including:

(1) a generally flat base having a bottom surface with oppositely disposed first and second bottom side edges, and (2) a peripheral wall extending upwardly of and in surrounding relation to said base to form a concavity operative to support the infant therein; and (B) a strap assembly secured to said resilient support, said strap assembly comprising:

(1) a primary strap terminating in first and second primary strap free end portions to define an effective primary strap length, said first and second primary strap free end portions releasably and directly connectable to one another whereby a portion of said primary strap may be extended across an infant placed in the concavity; and (2) an auxiliary strap terminating in first and second auxiliary strap free end portions, said first auxiliary strap free end portion releasably connected to said primary strap.

29. A changing pad according to claim 28 wherein said second auxiliary strap free end portion is releasably connectable to an article of furniture that is adapted to support said changing pad.

30. A changing pad according to claim 28 including a clamp element disposed on said primary strap for releasably connecting said auxiliary strap to said primary strap.

31. A changing pad according to claim 28 wherein said auxiliary strap is adjustably connected to said primary strap.

* * * * *